US006209724B1

(12) United States Patent
Miller

(10) Patent No.: US 6,209,724 B1
(45) Date of Patent: Apr. 3, 2001

(54) PACKAGE AND DISPENSER FOR GLASS FIBER FILTER PAD

(75) Inventor: William D. Miller, Hideaway Hills, OH (US)

(73) Assignee: Superior Fibers, Inc., Bremen, OH (US)

( * ) Notice: Subject to any disclaimer, the term of this patent is extended or adjusted under 35 U.S.C. 154(b) by 0 days.

(21) Appl. No.: 09/283,518

(22) Filed: Apr. 1, 1999

(51) Int. Cl.[7] ..... B65D 85/48

(52) U.S. Cl. ..... 206/449; 206/524.8; 206/526; 206/499; 383/209

(58) Field of Search ..... 206/524.8, 233, 206/526, 484, 499, 449; 383/207, 208, 209, 202

(56) References Cited

U.S. PATENT DOCUMENTS

| | | | | |
|---|---|---|---|---|
| 3,458,966 | * | 8/1969 | Dunbar et al. | 206/524.8 |
| 3,613,875 | | 10/1971 | Franke . | |
| 3,783,773 | | 1/1974 | Willard . | |
| 4,098,404 | | 7/1978 | Markert . | |
| 4,365,715 | * | 12/1982 | Egli | 206/524.8 |
| 4,875,328 | | 10/1989 | Meyer . | |
| 5,050,737 | * | 9/1991 | Joslyn et al. | 206/524.8 |
| 5,062,252 | | 11/1991 | Kupcikevicius . | |
| 5,091,233 | * | 2/1992 | Kirby et al. | 206/524.8 |
| 5,219,229 | * | 6/1993 | Senegewald | 383/207 |
| 5,351,463 | | 10/1994 | Aarts . | |
| 5,469,965 | * | 11/1995 | Stearns | 206/387.1 |
| 5,601,369 | * | 2/1997 | Moseley et al. | 383/209 |
| 5,611,626 | * | 3/1997 | Warr | 383/209 |
| 5,666,445 | * | 9/1997 | Conrad et al. | 383/207 |
| 5,744,289 | * | 4/1998 | Kobayashi et al. | 383/209 |
| 6,109,440 | * | 8/2000 | Cliff | 206/523 |

* cited by examiner

*Primary Examiner*—Paul T. Sewell
*Assistant Examiner*—Shian Luong
(74) *Attorney, Agent, or Firm*—Jason H. Foster; Kremblas, Foster, Millard & Pollick

(57) ABSTRACT

A dispenser for compressible fiberglass nonwoven pads including a bag into which a stack of fiberglass pads is placed. A significant portion of the air within the bag is removed, compressing the stack of filter pads to reduce space. At least two flanges are formed on two adjoining edges of the bag. The flanges can be cut along a portion of their length to form an aperture through which the filter pads can be removed, while retaining the filter pads until deliberate removal by hand.

6 Claims, 3 Drawing Sheets

PACKAGE AND DISPENSER FOR GLASS FIBER FILTER PAD

BACKGROUND OF THE INVENTION

1. Field of the Invention

The invention relates generally to filter media, and more specifically to an apparatus for dispensing packaged, compact filter media webs.

2. Description of the Related Art

Filter media webs, such as compressible nonwoven webs used for paint-room filtration, are lightweight and bulky. Filter webs are made of fiberglass or polymer strands that are adhered to one another at points of intersection to form a web. The web is cut into pads or formed into a roll. The pads or rolls are then transported to the user.

Transportation of the media from the manufacturer to the user accounts for a large part of the cost of the filter media. Although the media is inexpensive, a large amount of the space in the packaging is taken up by air. Therefore, a large amount of air is shipped with the media.

A packaging system by American Air Filter includes a package, such as a large bag. Filter pads are packaged for shipping by simply stuffing pads into the package in random orientations. Some amount of the air in the package is removed to decrease the package's size. However, when the package is opened to remove the first pad, some of the pads spring out randomly upon release of the compressive force of the vacuum.

The reason some of the pads spring out of the package is the random orientation of the filter pads. This random orientation makes some of the pads become compressed in the direction towards the eventual opening of the package. This results in some of the compressed pads springing towards the opening of the package. Unless a large number of pads are used immediately upon opening of the package, some pads will have to be put in another package, or risk becoming soiled.

Another method of packing filter pads involves compressing a stack of pads with a mechanical device or a weight, such as a steel plate. The compressed stack is then put in a rigid box as the compressing structure is removed. However, this method has the disadvantage that the handling of the compressed media must be carefully controlled to ensure that the compression is not released until the stack is contained within a package that can maintain the compression. Furthermore, removal of the first several compressed pads is difficult due to the force exerted against the box by the compressed filter media.

Therefore, the need exists for a method of packaging filter webs or pads that removes a significant amount of the air within the media to decrease shipping costs, and enhances the removal of the pads from the package. Furthermore, a dispenser is needed for dispensing packaged filter pads in an improved manner.

SUMMARY OF THE INVENTION

The invention is a dispenser for compressible fiberglass nonwoven pads. The invention includes a stack of substantially planar, substantially parallel fiberglass pads. The stack has first and second adjoining peripheral edges, and each peripheral edge has a predetermined length. The stack is enclosed in a fluid-impervious envelope, and the envelope has a fluidtight seal for preventing entrance of air into the envelope. The envelope has a first peripheral wall adjacent the first peripheral edge of the stack, and a second peripheral wall adjacent the second peripheral edge of the stack. The second peripheral wall adjoins the first peripheral wall of the envelope. First and second flanges are formed on the first and second peripheral walls of the envelope. Each flange is severable for at least about one-half the length of each of the adjacent peripheral edges of the stack for exposing a portion of the peripheral edges of the stack and permitting dispensing of the pads in the stack.

The invention also contemplates a method of making a dispenser. The method comprises forming a stack of substantially planar, substantially parallel fiberglass pads. The stack has first and second adjoining peripheral edges, each peripheral edge having a predetermined length. The stack is enclosed in a fluid containing, fluid-impervious envelope.

The envelope has a first peripheral wall adjacent the first peripheral edge of the stack, and a second peripheral wall adjacent the second peripheral edge of the stack and adjoining the first peripheral wall of the envelope.

Some of the fluid is drawn from the envelope and the envelope is sealed for preventing entrance of fluid into the envelope. First and second flanges are formed on the first and second peripheral walls of the envelope. Each flange is severable for at least about one-half the length of each of the adjacent peripheral edges of the stack.

In a preferred embodiment, flanges are formed on four walls of the envelope. Two adjacent flanges can be severed for about three-quarters of the length of the flange, forming an aperture at one corner of the envelope. One or more of the fiberglass pads can be removed from the envelope through the aperture.

Figure 1:
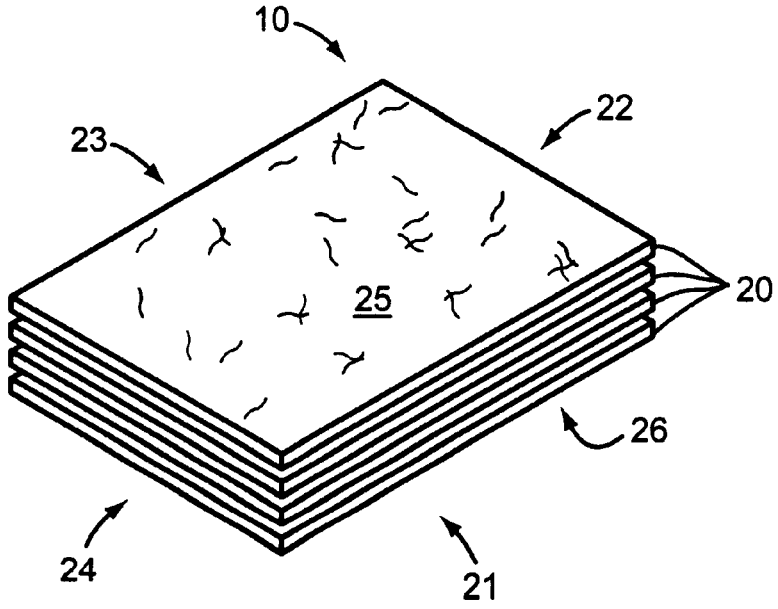
FIG. 1 is a view in perspective illustrating a stack of filter pads.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF THE PREFERRED EMBODIMENT

Figure 2:
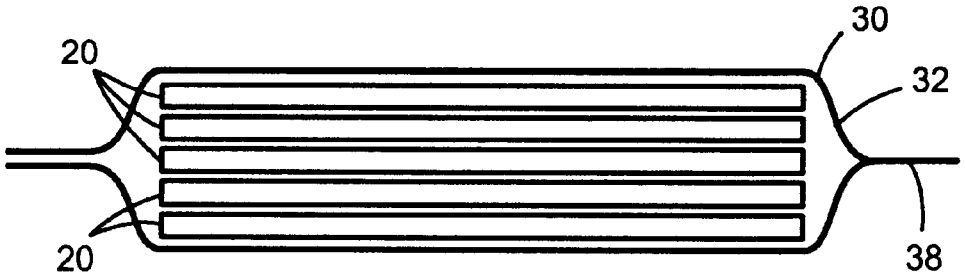
FIG. 2 is a side view illustrating a stack of pads in a bag prior to removal of air.
Figure 3:
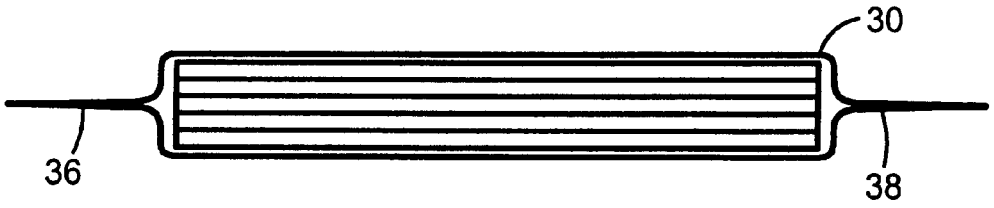
FIG. 3 is a side view illustrating a stack of pads in a bag after removal of some air.

In FIGS. 1, 2 and 3 a stack 10 of filter webs, preferably the nonwoven fiberglass pads 20, is shown. The stack 10 is formed of substantially planar pads 20 arranged in a substantially parallel, side-by-side relationship. Such pads can be used in a common filtration system that filters air drawn out of a paint room or booth, or can be used in any other filtration application.

The stack 10 has peripheral edges 21, 22, 23 and 24, and opposing major surfaces 25 and 26. The stack 10 preferably includes 25 pads, but could include more or less. An advantage of including 25 pads in the stack 10 is that an entire stack of this number may be installed into a very common paint room filtration system without the need to count the pads.

In their position shown in FIG. 1, the stack 10 consumes a large exterior volume, approximately two feet square and several feet tall. If the stack 10 were placed in a box this size, a large amount of the volume of the box would be made up of air. In order to reduce the volume consumed by the stack 10 during transportation to the end user, the stack 10 is placed within a fluid-impervious envelope, preferably the polymer film bag 30 shown in FIGS. 2 and 3, and reduced in size. As a precursor to placing the stack in the envelope, a means of mechanically compressing the stack, such as a pair of opposed plates mechanically driven together, for example, can be used to reduce the stack's thickness. Such a mechanical device can reduce a stack about 5 feet thick to about one inch thick, permitting the stack to be placed in the bag 30. This represents a thickness reduction of about 60 times. Of course, the stack could be reduced to only about 5 to 8 inches, representing a reduction of about 8 to 12 times, respectively.

Once the stack is placed in the bag 30 and the mechanical compressing means is removed, the stack 10 springs back to the thickness permitted by the size of the interior of the bag 30. This thickness is approximately eight to 10 inches in the preferred embodiment in which a stack of 25 two-and-one-half inch thick pads are in the stack 10.

The size of the bag 30 is reduced by removing some of the fluid, preferably air, from the interior of the bag 30. This is preferably accomplished by applying a vacuum to an opening in the bag 30. As air is being removed the bag's volume is reduced, and this volume reduction causes the bag's sidewalls to be drawn inwardly. The inwardly drawn sidewalls compress the stack 10 in a direction perpendicular to the plane of the stack. The compression of the stack is mostly perpendicular to the stack's plane. The larger sidewalls of the bag that face the major surfaces 25 and 26 of the stack 10 compress the stack in the direction perpendicular to the plane of the stack 10. Thus, the stack's thickness is reduced significantly more than its width or length, preferably to about one inch for a stack of 25 pads that are each two-and-one-half inch thick when uncompressed. Pads of any thickness can be compressed in this manner. This represents a reduction in size by vacuum of about ten times (from about 10 inches to about one inch thick). This indicates that a significant majority of the air in the bag 30 is withdrawn by vacuum. Preferably, at least the majority of air in the bag 30 is removed, and more preferably, enough air is removed to reduce a stack of 25 such pads to about one inch in thickness. This most preferred percentage could range from 51% to almost 100%.

As the thickness of the stack 10 is reduced until the bag and the stack form a structure like that shown in FIG. 3, the bag assumes the shape of the stack's exterior. The peripheral sidewalls 31, 32, 33 and 34 of the bag 30 are adjacent to, and preferably abut, the peripheral edges 21–24 of the stack 10. Four flanges 35, 36, 37 and 38 are formed extending from the peripheral walls 31–34, respectively, to the outer extremity of the bag 30.

The flanges 35–38 are formed as the bag's internal volume is reduced, and the sidewall material necessary to contain the compressed stack's volume is reduced. As the thickness of the bag 30 decreases during compression, the width of the flanges 35–38 increases. This is because the amount of bag sidewall previously required to span the distance between the top surface 25 and the bottom surface 26 of the stack 10 decreases as the stack thickness decreases. This sidewall material is forced outwardly, forming the flanges.

After the stack and bag combination has been reduced in size, it can be transported with significant cost savings. Furthermore, once it arrives at the end user, it functions as a dispenser.

Figure 6:
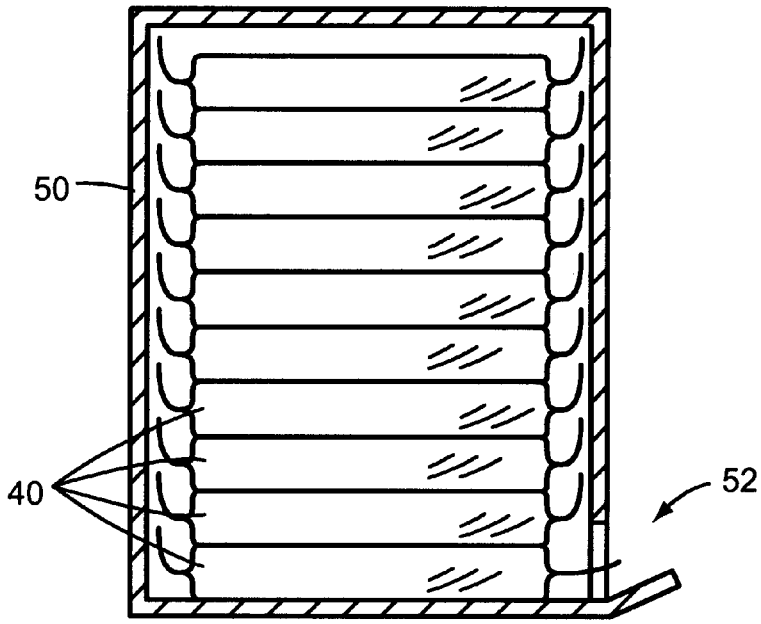
FIG. 6 is a schematic side view in section illustrating the elongated box for containing the preferred embodiment of the present invention.

The preferred means of shipping the bags containing the filter pads, the entire structure of which is called a dispenser, is to place several, for example ten, dispensers 40 in an elongated box, such as the box 50 shown in FIG. 6. Once the box 50 reaches the user, the user cuts the box 50 to form a slot 52 at the bottom. The dispensers 40 can be removed from the box 50 by sliding them out of the slot 52. If the box 50 is positioned as shown in FIG. 6, the dispensers 40 fall under the force of gravity to the bottom of the box 50 near the slot 52 once the lowest dispenser is removed through the slot.

Figure 4:
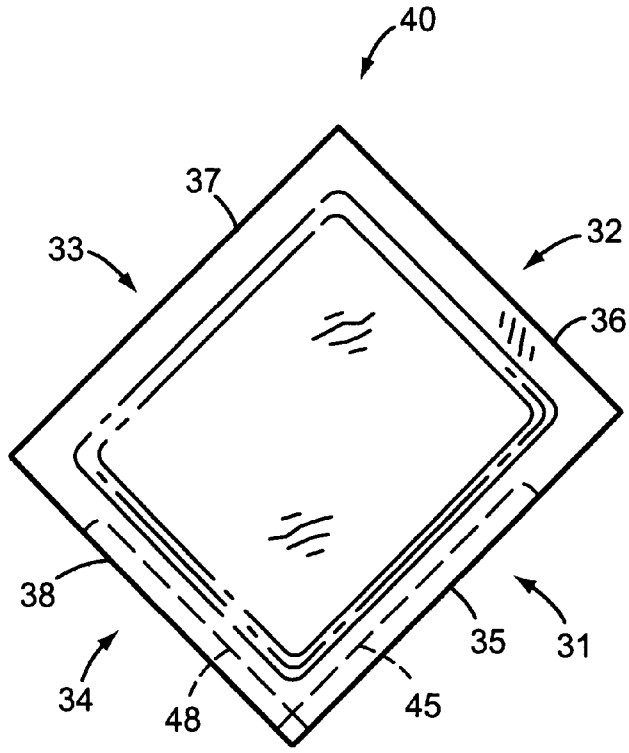
FIG. 4 is a top view illustrating a stack of pads in a bag after removal of some air.

After the dispenser 40 shown in FIG. 4 is removed from the box 50, it is opened. The opening of the dispenser is carefully formed to permit deliberate removal of the retained pads, while retaining all pads that are not deliberately removed from it. The dispenser is opened by cutting along two adjacent flanges, such as the flanges 35 and 38. The cut openings do not extend the entire length of the flanges, but are carefully formed within a preferred range of lengths. This opens the bag 30 an amount sufficient to permit removal of filter pads, but leaves enough of the bag to retain the pads.

In order to form the opening described, it is preferred that the openings formed on the adjoining flanges be between about one-half and three-quarters of the length of the adjacent side of the stack 10 contained within the bag 30. Openings 45 and 48 within this range are shown in phantom in FIG. 4. The openings 45 and 48 are preferably formed by cutting entirely through the sidewalls of the bag 30. However, only one sidewall need be cut.

The lengths of the openings relate to the size of the stack 10, because filter pads from the stack 10 must be removed through the openings, and the remaining stack must be retained within the bag 30 after the openings are formed. The openings 45 and 48 intersect at their ends, forming a large, generally V-shaped aperture 49 extending from one end of the opening 45 to the opposite end of the opening 48.

The aperture 49 has a predetermined size, because only a portion of the bag's sidewalls are cut open. The portion that remains uncut serves an important function, and therefore its size must be suited to that function. After formation of the aperture 49, enough of the bag's peripheral walls remain uncut to retain the filter pads while simultaneously permitting removal of some or all filter pads.

Figure 5:
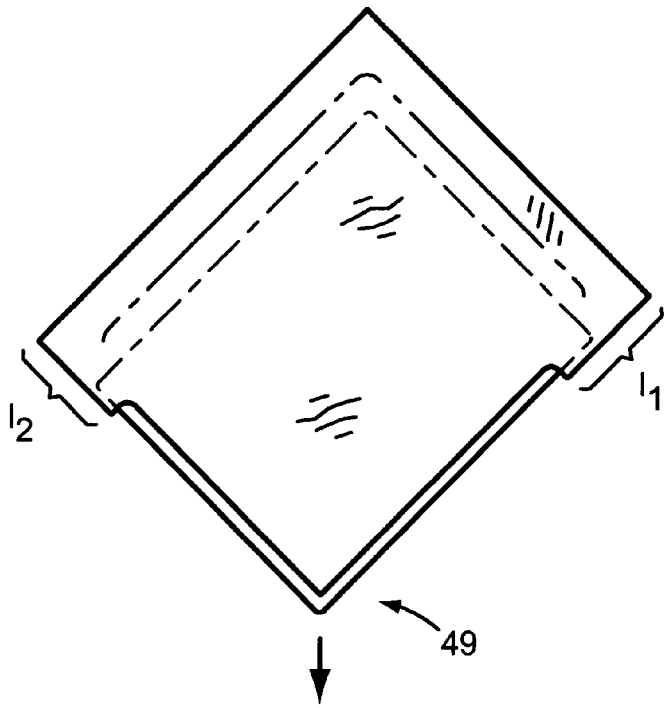
FIG. 5 is a top view illustrating a stack of pads protruding from an opening formed in a bag.

The upper portions of two adjacent peripheral edges of the stack 10 within the bag 30 abut the remaining, uncut portions of the bag's peripheral walls. The lengths of these remaining, uncut portions are denoted $l_1$ and $l_2$ in FIG. 5. The lengths $l_1$ and $l_2$ of the remaining, uncut portions must be large enough to prevent the relatively flexible stack of filter pads from simply folding away from the bag's peripheral walls and dropping out of the aperture 49.

The minimum length of each remaining, uncut portion is about one fourth of the length of the two peripheral edges of the stack 10. This is the minimum portion of the edges of the stack 10 that must be supported to prevent the stack 10 from simply folding slightly, and sliding out of the aperture 49. Of course, if there are more or less filter pads in a different stack the minimum length of the remaining, uncut portions necessary to prevent the stack from sliding out may be affected.

There is also a maximum length for each remaining, uncut portion. This length is about one-half the length of each of the adjacent peripheral edges of the stack. This maximum is necessary because any remaining, uncut portions exceeding the maximum length would decrease the size of the aperture 49, and would interfere significantly with the removal of filter pads through the aperture 49.

Therefore, based upon the minimum and maximum lengths of each remaining, uncut portion, each flange must be severable, which means able to be severed or cut, for a minimum and maximum length. The minimum length is about one-half of the length of each of the adjacent peripheral edges of the stack, and the maximum length is about three-quarters of the length of each of the adjacent peripheral edges of the stack.

Upon cutting the bag 30, air begins to enter it, permitting rapid expansion of the bag 30 as the compressed stack of pads 20 exerts forces against the sidewalls of the bag 30. Because the pads 20 are preferably fiberglass, which has substantially 100% memory, the pads 20 resume their original shape once all forces, such as from the bag sidewalls, are removed.

Once the aperture 49 is completely formed, one or more of the pads 20 in the stack 10 can then be removed by hand simply by grasping the desired number of pads through the aperture 49 and pulling away from the rest of the stack 10. Each pad is removed by sliding it out the aperture 49 parallel to the underlying pads. It is preferred that once the aperture 49 is formed, the dispenser 40 is hung with the aperture 49 facing generally downwardly, so that pads can be removed by pulling downwardly.

The present invention functions as a dispenser by retaining the pads after cutting the flanges because the compressed pads do not exert any significant amount of spring force out toward the openings formed on the bag 30. Such a force might cause pads to be pushed out of the aperture 49 if it existed. The opposing major surfaces 25 and 26 of the stack 10 exert the greatest force against the bag 30, but in a direction perpendicular to the plane of the stack and away from the aperture 49. The peripheral edges 21–24 of the stack, which face out of the aperture 49, exert essentially no force in the direction of the aperture 49. Therefore, no force tends to push the pads out of the aperture 49.

The reason no significant force is directed towards the aperture 49 is that essentially all of the compression of the stack 10 is in the thickness direction (perpendicular to the stack's plane). The potential energy stored in the compression of the stack and released upon cutting the bag 30 open is released in a direction that does not tend to push pads 20 out of the bag 30. Because there is virtually no compression along the plane of the stack 10, virtually no force is exerted along the plane as the compression is released. Instead, the direction of force has been carefully chosen to be exerted perpendicular to the plane of the stack. Therefore, unlike the prior art, none of the pads of the present invention will be forced out of the carefully constructed aperture 49, because the aperture 49 is at the edge of the stack. Therefore, stacking in parallel, side-by-side relationship is critical, as is the position of the aperture 49 relative to the stack.

Because there is no concern that the pads will spring out of the bag upon cutting, more of the air in the bag can be removed, reducing the overall size of the dispenser even further. For example, according to the present invention approximately 500 pads can be put in a container of a size that, using the prior art filter packaging method and structure, could only hold 100 to 200.

The preferred embodiment of the present invention has flanges on all four peripheral edges of the bag. However, only two flanges on adjacent edges are necessary to form the opening described in the preferred embodiment. The flanges provide a part of the bag that can be cut to form an opening, while virtually eliminating the possibility that the process of cutting the opening will result in cutting of the filter pads.

Figure 7:
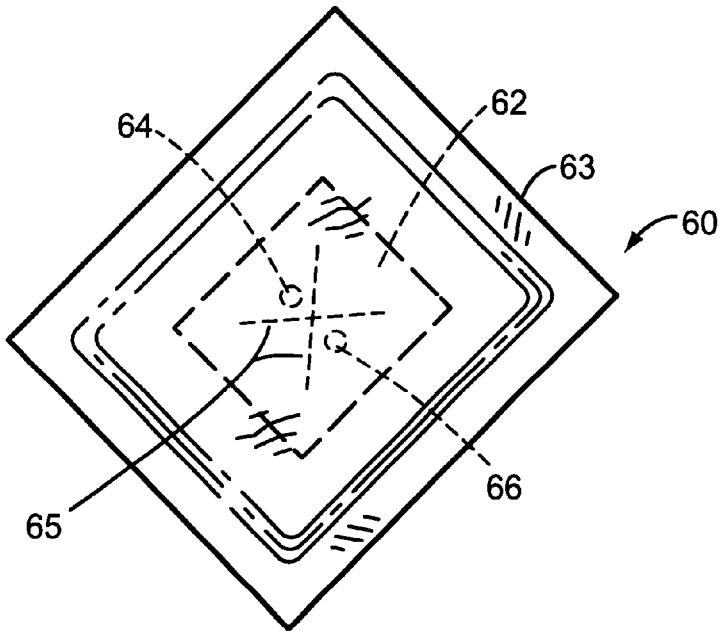
FIG. 7 is a view in perspective illustrating an alternative embodiment of the present invention.

An alternative embodiment to the preferred dispenser is the dispenser 60 shown in FIG. 7. The dispenser 60 is essentially identical to the dispenser 40 shown in FIG. 4, except for the cardboard panel 62 interposed between the top fiberglass filter pad and the bag sidewall. The panel 62 is preferably placed in the bag 63 prior to removing a significant amount of air from the bag according to the preferred embodiment. The panel 62 is preferably cardboard, but could, of course, be made of paper, paperboard, plastic or any other suitable material.

The panel 62 has two intersecting lines 65 drawn on its upper surface so that the lines 65 are visible through the bag's sidewall to a user. The panel 62 also has a pair of holes 64 and 66 formed through the panel. The length and width of the panel 62 is significantly smaller than the filter pads in the dispenser 60.

When the dispenser 60 is to be opened, the bag sidewall is cut, such as with a utility knife, along the intersecting lines 65 to form two intersecting slits. The panel 62 prevents the tool used to cut the bag sidewall from cutting the filter pads. Therefore, the panel must be sufficiently cut-resistant that a force that can cut the bag 63 does not cut through the panel 62.

After cutting of the bag 63, the user inserts his or her fingers into the holes 64 and 66 and pulls on the panel 62. Upon the application of a sufficient force, the panel 62 will come out through the opening.

The opening formed by the intersecting slits permits removal of the panel 62, but retains the larger filter pads. One or more filter pads can be removed from the dispenser 60 by gripping it through the opening with opposing fingers and pulling.

While certain preferred embodiments of the present invention have been disclosed in detail, it is to be understood that various modifications may be adopted without departing from the spirit of the invention or scope of the following claims.

What is claim is:

1. A dispenser for a stack of substantially planar, substantially parallel compressible nonwoven fiberglass pads, each pad having peripheral pad edges and first and second opposing major surfaces lying in first and second major surface plans, respectively, each major surface having substantially more surface area than any peripheral pad edge, the stack having first and second adjoining peripheral stack edges, each peripheral stack edge having a predetermined length, the dispenser comprising:

(a) a fluid-impervious envelope in which the stack is enclosed, said envelope having a fluidtight seal for preventing entrance of air into the envelope, the envelope also having first and second adjoining peripheral walls, said first and second peripheral walls lying in first and second peripheral wall planes, respectively, that are transverse to the first and second major surface planes of the pads, said first peripheral wall being adjacent the first peripheral stack edge, and said second peripheral wall being adjacent the second peripheral stack edge; and (b) first and second elongated openings formed in the first and second peripheral walls, each opening extending for at least about one-half and no more than an about three-quarters the length of each of the adjacent peripheral stack edges, said elongated openings intersecting at a common end to form a dispensing aperture that exposes a portion of the peripheral stack edges and permits dispensing of the pads in the stack.

2. A dispenser in accordance with claim 1, further comprising a removable panel interposed between the envelope and the stack.

3. A dispenser in accordance with claim 1, further comprising indicia on the flanges indicating a maximum and minimum length the flanges are to be severed.

4. A dispenser for a stack of substantially parallel compressible nonwoven fiberglass pads, the stack having a major surface, the dispenser comprising:

(a) fluid-impervious envelope in which the stack is enclosed, said envelope having a fluid tight seal for preventing the entrance of air into the envelope after air has been withdrawn; and (b) a removable panel interposed between the envelope and the stack at the stack's major surface for protecting the pads during cutting of a part of the envelope seated against the panel;

wherein the envelope is translucent, and further comprising indicia on the removable panel indicating where the envelope is to be cut.

5. A dispenser in accordance with claim 4, further comprising indicia on the envelope indicating where the envelope is to be cut.

6. A dispenser in accordance with claim 4, wherein the removable panel has at least one hole into which a user's finger can be inserted for grasping the removable panel for removing from the dispenser.

* * * * *